US007581811B2

(12) United States Patent
Katayama

(10) Patent No.: US 7,581,811 B2
(45) Date of Patent: Sep. 1, 2009

(54) INKJET PRINTER

(75) Inventor: Naoki Katayama, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 450 days.

(21) Appl. No.: 11/273,146

(22) Filed: Nov. 14, 2005

(65) Prior Publication Data

US 2006/0103690 A1 May 18, 2006

(30) Foreign Application Priority Data

Nov. 15, 2004 (JP) ..... 2004-330488
Nov. 15, 2004 (JP) ..... 2004-330489

(51) Int. Cl.
*B41J 2/165* (2006.01)

(52) U.S. Cl. ..... 347/29

(58) Field of Classification Search ..... 347/29
See application file for complete search history.

(56) References Cited

U.S. PATENT DOCUMENTS 7,077,495 B2 * 7/2006 Kawashima ..... 347/29

FOREIGN PATENT DOCUMENTS

JP A-5-201000 8/1993
JP B2-3417449 6/2003

* cited by examiner

*Primary Examiner*—Julian D Huffman
*Assistant Examiner*—Jason S Uhlenhake
(74) *Attorney, Agent, or Firm*—Reed Smith LLP

(57) ABSTRACT

There is disclosed an inkjet printer including: a printhead having a front surface in which is formed at least one nozzle row consisting of a plurality of nozzles from each of which a droplet of ink is ejected; a maintenance unit including a purge cap which receives ink from the nozzles during a purging operation, the purge cap having a contact surface to be brought into contact with the front surface of the printhead, and at least one main channel extending alongside the nozzle row; and a plurality of dents formed on at least one of the contact surface of the purge cap and the front surface of the printhead so as to form, at least when the contact surface is in contact with the front surface, a plurality of branches a part of each of which is in communication with at least one of the nozzles, and another part of each of which is in communication with the main channel.

22 Claims, 16 Drawing Sheets

INKJET PRINTER

INCORPORATION BY REFERENCE

The present application is based on Japanese Patent Applications Nos. 2004-330488 and 2004-330489, both filed on Nov. 15, 2004, the contents of which are incorporated herein by reference.

BACKGROUND OF THE INVENTION

1. Field of the Invention

The present invention relates to an inkjet printer.

2. Description of Related Art

As a kind of recording apparatus for recording information on a recording medium such as a sheet of paper, there is known an inkjet printer that ejects ink droplets onto a recording medium to record information. Such an inkjet printer includes an actuator, a printhead, and a maintenance unit including a purge cap. The printhead has ink passages formed therein, and a nozzle surface where a plurality of nozzles for ejecting ink droplets therefrom are arranged. In the inkjet printer, the printhead is movable between a recording area and a purge area adjacent to the recording area. The printhead performs printing on the recording medium while reciprocated across the recording area. The printhead is located at the purge area when a purging operation is performed with the nozzle surface covered with the purge cap so that the purge cap receives ink discharged or sucked from the nozzles for purging.

In the printhead for the inkjet printer, the nozzle surface is usually constituted by an external surface of a nozzle film that is coated with a water repellent material. The nozzle film is formed of polyimide, for instance. In such an arrangement, the nozzle surface is brought into frictional contact with the recording medium, and the water repellent coating and the nozzle film tend to be damaged. Recently, to meet a demand for a higher print rate, the size of the nozzle surface has been increased, thereby further increasing the risk of damage of the nozzle film and the water repellent coating thereon.

As a technique for coping with this disadvantage, there is known an arrangement where the nozzle surface is covered with a metallic cover plate, except at and around a row of the nozzles, so as to constitute a front surface of the printhead by the cover plate and a part of the nozzle surface as exposed through a through-hole formed in the cover plate, as disclosed in JP-A-5-201000 (especially paragraphs 0020, 0021 and FIGS. 1 and 2), for instance.

Since the cover plate has such a through-hole, ink remaining on the front surface can not be completely removed when the front surface is wiped with a wiper immediately after a purging operation.

After a purging operation, a mixture of small bubbles and ink droplets is inside the purge cap. At a moment when the purge cap is separated from the front surface of the printhead, this mixture is drawn into a nozzle because of a negative pressure in the printhead. The bubbles contained in the mixture and drawn into the nozzle thereafter remain in the ink passage extending from that nozzle, thereby attenuating a pressure wave which is generated in the ink passage when the actuator is driven to eject an ink droplet from the nozzle, during a printing operation. Hence, stability can not be assured in ejection performance of the printhead.

As a countermeasure to the instable ejection performance, deaerated ink is used in the inkjet printer so that the bubbles introduced into the nozzles are dissolved in the deaerated ink to restore the ejection performance. However, it takes some time to dissolve the bubbles in the ink, and thus it is necessitated to wait until the time elapse before the next printing is started.

SUMMARY OF THE INVENTION

The present invention has been developed in view of the above-described situations, and therefore it is an object of the invention to provide an inkjet printer capable of preventing a bubble, as generated in a purging operation during which a purge cap covers a front surface of the printhead, from being introduced into a nozzle upon separation of the purge cap from the front surface after the purging operation.

To attain the above object, the present invention provides an inkjet printer including:

- a printhead having a front surface in which is formed at least one nozzle row consisting of a plurality of nozzles from each of which a droplet of ink is ejected;
- a maintenance unit including a purge cap which receives ink from the nozzles during a purging operation, the purge cap having a contact surface to be brought into contact with the front surface of the printhead, and at least one main channel extending alongside the nozzle row; and
- a plurality of dents formed on at least one of the contact surface of the purge cap and the front surface of the printhead so as to form, at least when the contact surface is in contact with the front surface, a plurality of branches a part of each of which is in communication with at least one of the nozzles, and another part of each of which is in communication with the main channel.

The purging operation may be performed by at least one of sucking ink from the nozzles, and pressurizing the ink from the inside of the printhead.

The main channel may be formed as a covered channel formed inside the purge cap. However, in most cases, forming the main channel as a non-covered channel that is open in the contact surface makes production of the inkjet printer easier than when the main channel is a covered one. Where the main channel is formed as a covered channel, each of the branches should be covered at least at an end thereof where the branch is connected with the covered main channel.

According to the arrangement of the invention, when the front surface of the printhead is covered by the purge cap at the purging position in the purging area, each of the dents forms between the printhead and the purge cap a small void or chamber in communication with at least one of the nozzles. Each small chamber is communicated with a discharge hole via the branch and the main channel. Bubbles generated in an initial phase of the purging operation are discharged or sucked along with the ink. The small chamber into which the at least one nozzle opens is completely filled with the ink quickly, and thereafter a bubble does not occur. An air space surrounding each nozzle and corresponding to the small chamber is defined by the dent, thereby reducing a volume of air present around each nozzle. This is advantageous in reducing generation of bubbles and quickly discharging or sucking generated bubbles.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described presently preferred embodiments of the invention, by referring to the accompanying drawings.

Figure 1:
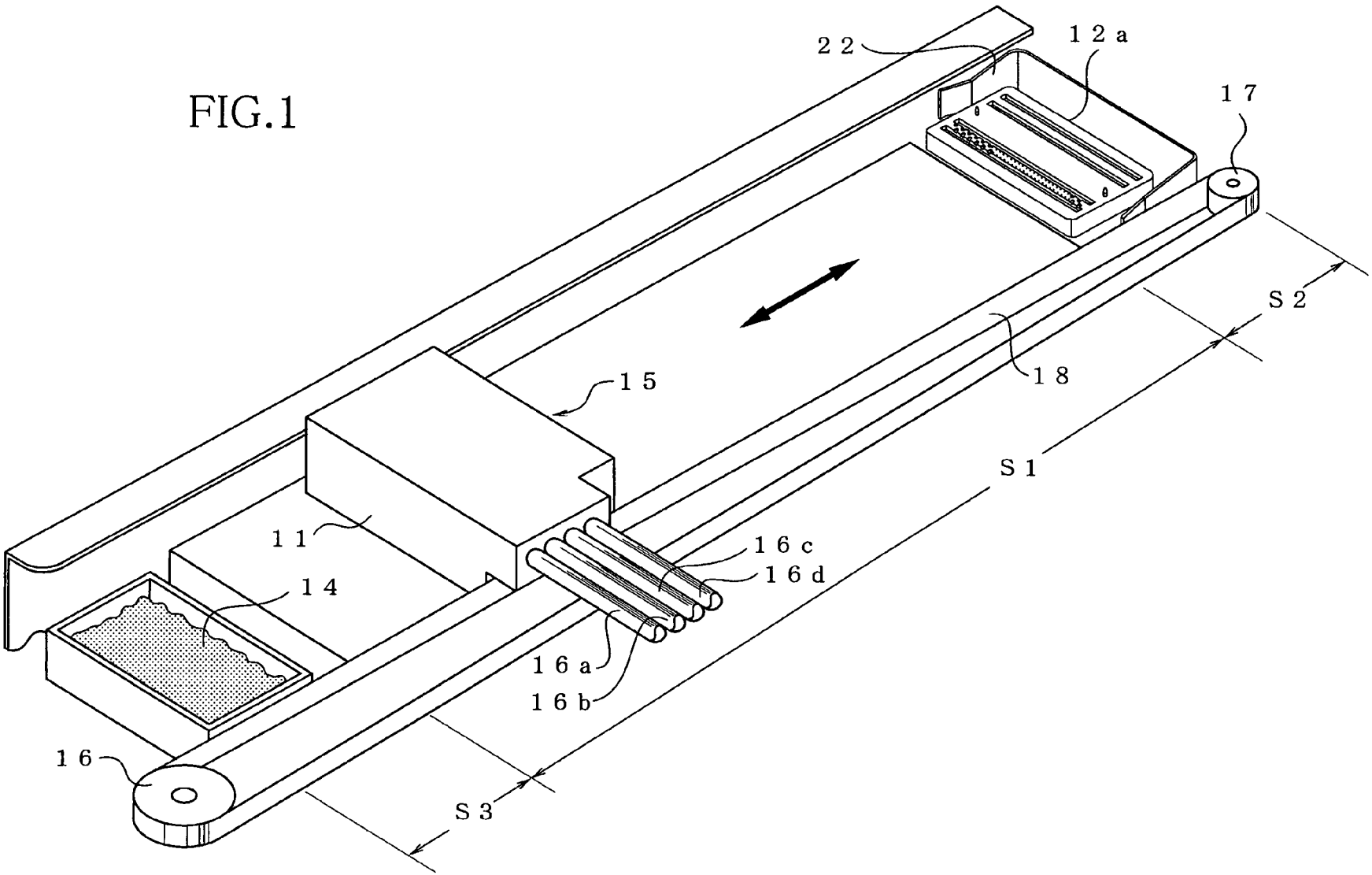
FIG. 1 is a schematic perspective view of a principal portion of an inkjet printer according to a first embodiment of the invention.
Figure 2:
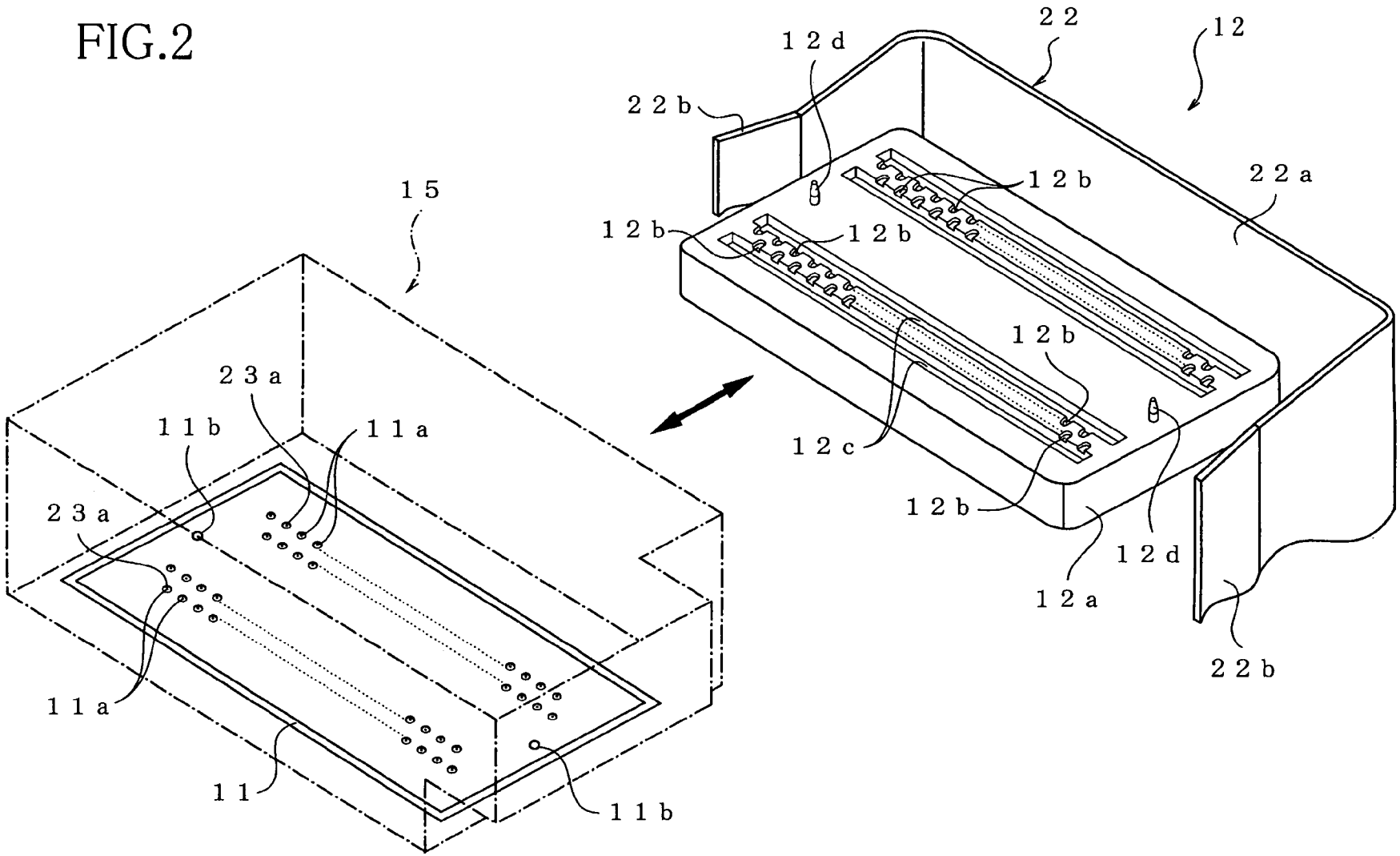
FIG. 2 is a perspective view of a printhead, a purge cap, and a positioning member of the inkjet printer.

Referring to FIGS. 1 to 7, there will be described an inkjet printer according to a first embodiment of the invention. As shown in FIGS. 1 and 2, the inkjet printer includes an inkjet printhead 11, a maintenance unit 12 that is a purging device, and an ink receiving portion 14. In the inkjet printer, the printhead 11 can be reciprocated across three areas, namely, a recording area S1, a purging area S2, and a flashing area S3. The purging area S2 and the flashing area S3 are on the opposite sides of the recording area S1. The printhead 11 has a plurality of nozzles 11*a* each for ejecting an ink droplet therefrom onto a recording medium such as a sheet of paper. Printing on the recording medium is performed while the printhead 11 is reciprocated across the recording area S1. A purging operation is performed when the printhead 11 is located at the purging area S2 where the maintenance unit 12 is disposed. The maintenance unit 12 includes a purge cap 12*a* for receiving ink discharged or sucked from the nozzles 11*a* of the printhead 11 in the purging operation. The ink receiving portion 14 is disposed at the flashing area S3, which is a place where a flashing operation to eject ink droplets from the nozzles is periodically performed during a recording operation, in order to prevent the nozzles from drying.

In this inkjet printer, the purging operation is implemented when ink is introduced into the printhead 11 for the first time, and when the inkjet printer has not been used for a predetermined period of time. The purging operation may be implemented in any other suitable situations, such as when an ink ejection characteristic of the printhead 11 has changed to a degree that the flashing operation can not compensate for the change. The purging operation is implemented in order to suck a bubble and foreign matter that may be present in ink passages extending to the nozzles. When the purging operation is to be implemented, the printhead 11 is moved into the purging area S2 adjacent to the recording area S1, and then a front surface of the printhead 11 from which ink droplets are to be ejected is covered by the purge cap 12*a*. Thereafter the purging operation is implemented, namely, ink droplets are sucked from the nozzles 11*a*.

Although not shown specifically, the printhead 11 is mounted on a head holder (not shown) along with a buffer tank. The printhead 11, the buffer tank, and the head holder constitute a recording device 15 for recording information while being reciprocated in a main scanning direction that is perpendicular to a feeding direction in which the recording medium is fed. Inks of respective colors, that is, black, cyan, magenta, and yellow, are supplied from respective ink tanks (not shown) into the printhead 11 via ink supply tubes 16*a*-16*d* and after temporarily stored in the buffer tank on the head holder. The ink tanks are removably disposed on a frame (not shown) of the printer and stores large amounts of the inks to be supplied to the printhead 11. When the ink in any ink tank is depleted, replacement of the ink tank is implemented along with a purging operation as a maintenance work.

The head holder or the recording device 15 is slidably supported by a pair of guide members (not shown) arranged side-by-side in a front-rear direction and extending in a lateral direction of the printer parallel to each other. The head holder is coupled with an endless timing belt 18 entrained around a drive pulley 16 and a driven pulley 17. When the drive pulley 16 is rotated by a driving motor (not shown), the recording device 15 coupled with the timing belt 18 is reciprocated in the lateral direction along the guide members. Although not shown, the recording medium is fed by a well known feeder mechanism such that the printhead 11 can record information on the recording medium as passing under the printhead 11 in the direction perpendicular to the main scanning direction which is the reciprocating direction of the recording device 15.

As shown in FIG. 2, the nozzles 11*a* are arranged in a plurality of rows in the front surface of the printhead. Each nozzle row is for ejecting droplets of ink of one of the four colors, i.e., black, cyan, yellow, and magenta, and extends in a direction perpendicular to the main scanning direction. Each nozzle 11*a* is open or exposed downward so as to be opposed to an upper surface of the recording medium.

Figure 4:
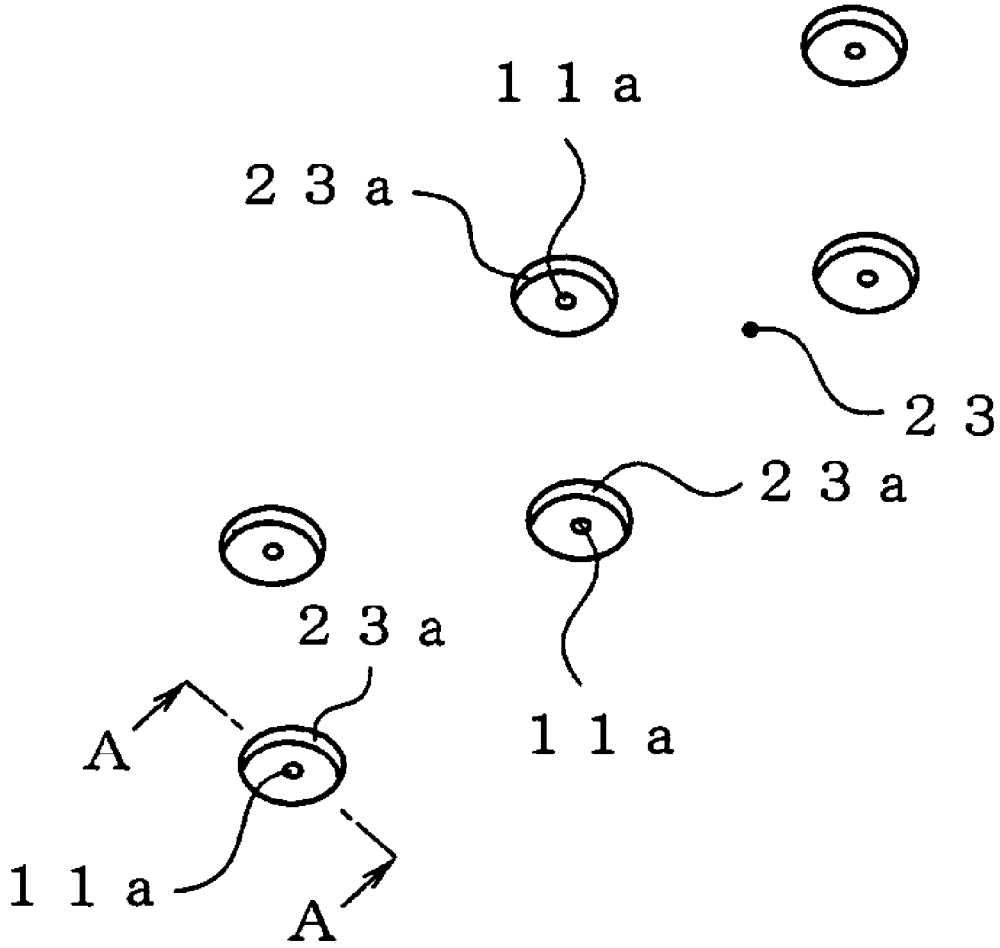
FIG. 4 illustrates a front surface of the printhead in which nozzles are arranged.
Figure 5:
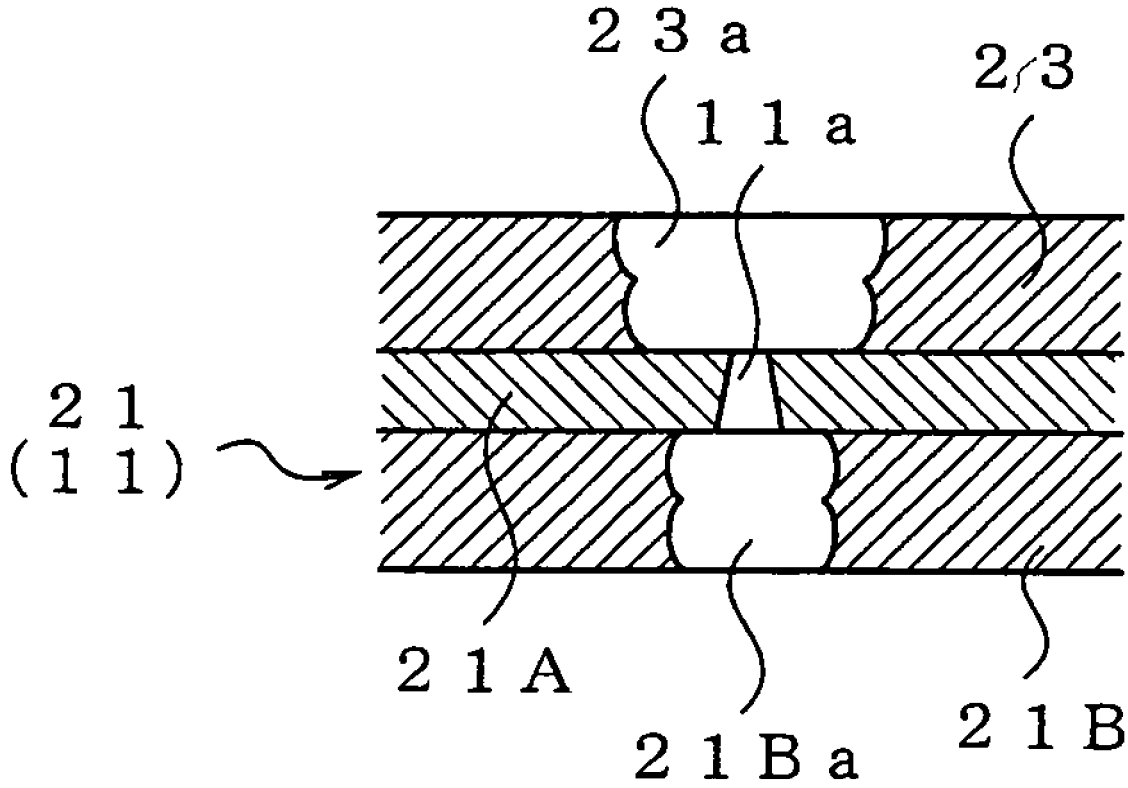
FIG. 5 is a cross-sectional view taken along line A-A in FIG. 4.

The printhead 11 includes a cavity unit 21 and an actuator (not shown), and the cavity unit 21 has a nozzle surface where the nozzles 11*a* for ejecting ink droplets therethrough are arranged, a plurality of pressure chambers in communication with the respective nozzles 11*a*, and manifolds for storing introduced inks before the inks are supplied to the pressure chambers through openings connecting the manifolds with the pressure chambers. The actuator operates to have ink droplets eject from the nozzles 11*a*, so as to record information on the recording medium. FIG. 4 is a fragmentary enlarged view of the front surface of the printhead 11, and FIG. 5 is a cross-sectional view taken along line A-A in FIG. 4 and showing one of the nozzles 11*a* and its vicinity in enlargement. As seen in FIG. 4 showing a part of two adjacent nozzle rows, the nozzles 11*a* are arranged in a staggered fashion such that each nozzle row is misaligned relatively to an adjacent nozzle row by half a pitch at which the nozzles 11*a* are arranged in each row. As shown in FIGS. 4 and 5, the nozzle surface of the cavity unit 21 where the nozzles 11*a* are formed is covered with a cover plate 23 having through-holes 23*a* at positions corresponding to the nozzles 11*a* so that the nozzle surface is protected by the cover plate 23. That is, as shown in FIG. 5, each of the through-holes 23*a* is formed in the cover plate 23 with one of the nozzles 11*a* located substantially at a center of the through-hole 23*a*, and thus a part of the nozzle surface around the nozzle 11*a* is exposed through the through-hole 23*a*. The through-hole 23*a* is configured to have a diameter larger at an open end thereof on the side of the nozzle surface than at the other open end on the side of the external surface of the cover plate 23. The front surface of the printhead is coated with a water repellent material 24, such that an inside of each through-hole 23*a* including the part of the nozzle surface surrounding each nozzle 11*a* is also coated with the water repellent material 24. Thus, damage of a nozzle film (described later), a surface of which constitutes the nozzle surface, at the nozzles 11*a* or therearound due to frictional contact with a recording medium or others is prevented. Hence, stable ink ejection performance is ensured.

Figure 7:
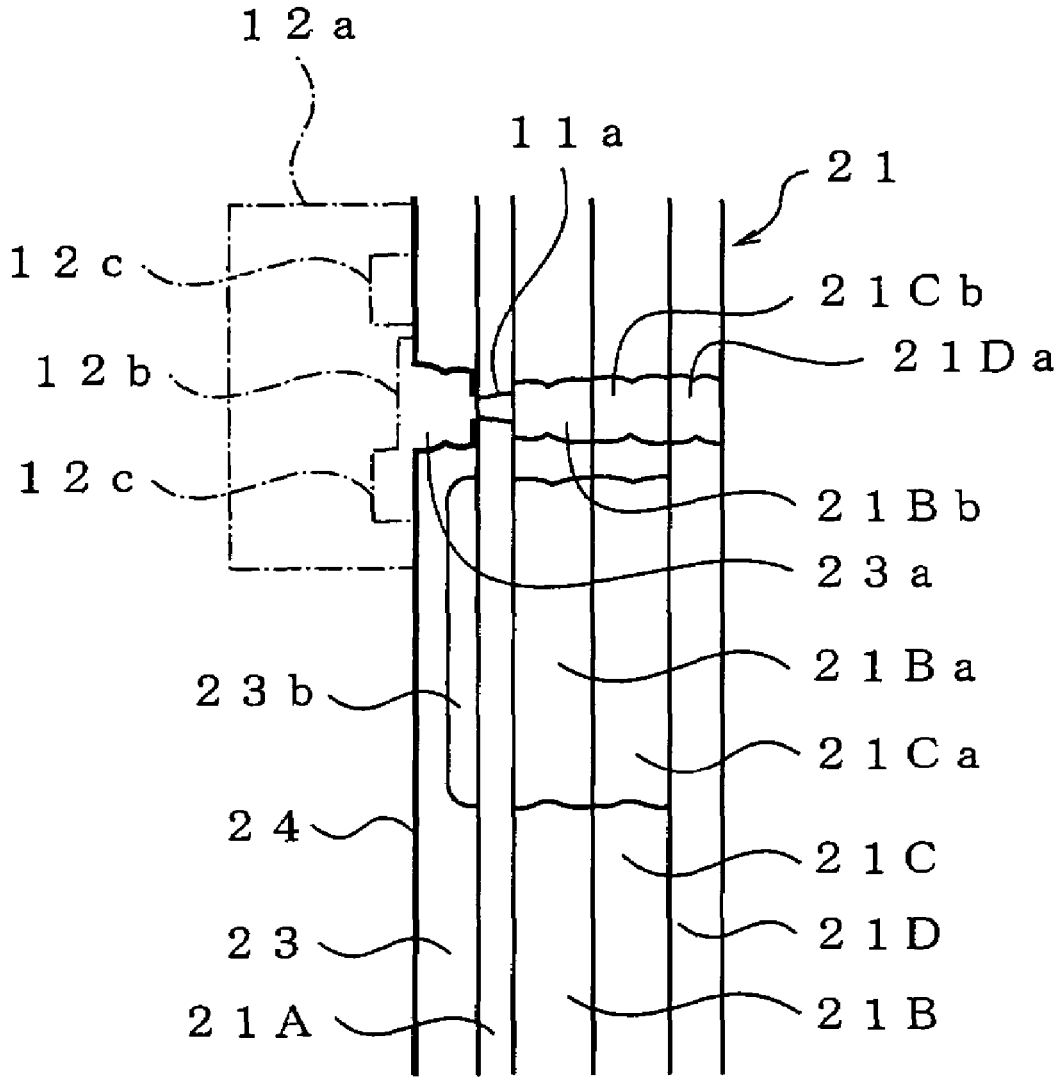
FIG. 7 is a cross-sectional view taken along line B-B in FIG. 6.

Referring to FIG. 7, there will be described a laminar structure of the cavity unit 21. FIG. 7 is a cross-sectional view showing a part of the cavity unit 21 in enlargement, in which a contour of the purge cap 12*a* in contact with the front surface of the printhead is indicated by chain line.

As shown in FIG. 7, the nozzles 11*a* are formed through a nozzle film 21A partially constituting the cavity unit 21. The nozzle film 21A may be formed of a polyimide film, for instance. The cavity unit 21 is constructed such that the nozzle film 21A is sandwiched between the cover plate 23 and a stack of other plates superposed one on another and bonded with an adhesive, including a pair of manifold plates 21B, 21C and a supply plate 21D. Through the manifold plates 21B, 21C, there are formed manifold holes 21Ba, 21Ca constituting manifolds in communication with the pressure chambers, and communication holes 21Bb, 21Cb each pair of which is in communication with one of the nozzles 11*a* so that ink flown from a corresponding one of the pressure chambers reaches the nozzle 11*a* via the pair of communication holes 21Bb, 21Cb. Through the supply plate 21D, there are formed communication holes 21Da each of which is in communication with one of the pairs of communication holes 21Ba, 21Ca so that the ink flown from the corresponding pressure chamber reaches the nozzle 11*a* via the communication hole 21Da also. The cover plate 23 has recesses 23*b* each serving as a damper chamber for attenuating vibration in the ink inside the corresponding manifold, or manifold holes 21Ba, 21Ca. That is, the nozzle film 21A serves as a damper plate. The recesses 23*b* are open toward the nozzle film 21A.

There will be now described how a maintenance operation of the inkjet printer is performed. As described above, the maintenance unit 12 disposed in the frame of the printer and at the purging area S2 located at an end of a reciprocation range of the printhead 11. The purging device 12 selectively sucks ink of a color so as to restore the ink ejection performance of the printhead at the corresponding nozzle row to an initial state. At the flashing area S3 at an opposite end of the reciprocation range of the printhead 11, the ink receiving portion 14 for receiving ink ejected from the nozzles 11*a* in a flashing operation, which is a periodically performed operation to eject ink droplets from the nozzles 11*a* during a recording operation in order to prevent the nozzles from drying. The purging device 12 includes the purge cap 12*a* capable of contacting the front surface of the printhead 11. The purge cap 12*a* is vertically displaceable in a similar manner as a known purging device is, so that there can be made a capping action to bring the purge cap 12*a* into contact with the front surface of the printhead, and a separating action to move the purge cap 12*a* away from the front surface of the printhead.

Reaching of the recording device 15 to a wait position where recording is not performed is detected by a position sensor disposed in a pathway along which the recording device 15 is moved. Then, the purge cap 12*a* at the wait position is elevated to a first vertical position to contact the front surface of the printhead 11. On the other hand, when the printhead 11 is located at a position other than the wait position, the purge cap 12*a* is lowered or retracted from the first vertical position to a second vertical position away from the front surface of the printhead. The purge cap 12*a* is connected to a suction pump (not shown) in a similar manner as in a known maintenance unit, so that foreign matter and the ink whose viscosity has increased are sucked and removed from the inside of the nozzles 11*a* when the suction pump is driven.

Figure 3:
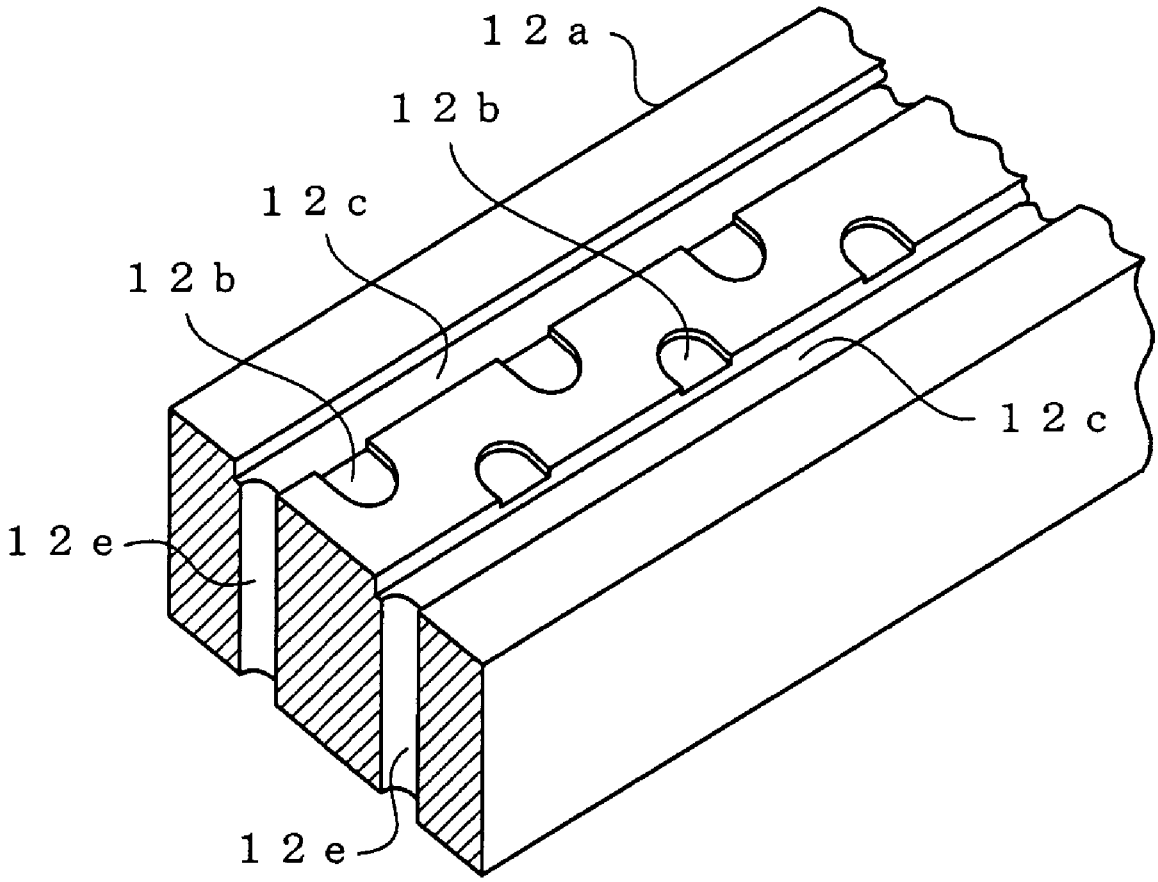
FIG. 3 shows the purge cap.

There will be now described a structure of a contact surface of the purge cap 12*a*, which structure is the characterizing portion of the first embodiment of the invention, with reference to FIGS. 2 and 3 in which FIG. 3 is a perspective view showing in enlargement a part of the purge cap 12*a*, which part includes two nozzle rows.

The contact surface of the purge cap 12*a* has a plurality of dents 12*b* as branches of ink drain channels, and a plurality of grooves 12*c* each as a main channel of an ink drain channel. When the front surface of the printhead is covered with the purge cap 12*a* at a purging position in the purging area S2, a first one of opposite end portions of each of the dents 12*b* forms a small void or chamber into which a corresponding one of the nozzles 11*a* opens. Each of the grooves 12*c* extends along an extending direction of each nozzle row to communicate the dents 12*b* with one another at their second end portions.

The dents 12*b* are formed on the contact surface of the purge cap 12*a*, at respective positions corresponding to the through-holes 23*a* of the cover plate 23 of the printhead 11. A part of each of the dents 12*b* which part is opposed to the through-hole 23*a* has an area larger than an area of an open end of the through-hole 23*a*. In accordance with the staggered arrangement of the nozzles 11*a* or the through-holes 23*a*, the dents 12*b* are also arranged in rows in a staggered fashion. The dents 12*b* are formed such that when the front surface of the printhead is covered with the purge cap 12*a*, a plurality of individual small voids or chambers are formed between the purge cap 12*a* and the printhead 11, more specifically, between the first end portions of the dents 12*b* and the through-holes 23*a* opposed thereto. Each dent 12*b* in a first one of the rows extends from its first end portion in a first direction, and each dent 12*b* in a second one of the rows which is adjacent to the first row extends from its first end portion in a second direction opposite to the first direction. In each dent 12*b*, the first end portion opposed to the through-hole 23*a* and an extended portion thereof not opposed to the through-hole 23*a* have a substantially same width. Hence, even in a case where the front surface of the printhead and the purge cap 12*a* contact each other with a positional error therebetween in the reciprocating direction of the printhead 11, the through-holes 23*b* are reliably positioned to be opposed to the dents 12*b*, and also a problem that a single dent 12*b* is opposed to a plurality of through-holes 23*a* does not occur. Thus, this embodiment has a high degree of freedom in respect of an error in the relative position between the printhead 11 and the purge cap 12*a* in the reciprocating direction.

Each groove 12*c* extending alongside the corresponding nozzle row is formed to communicate the second end portions of the dents 12*b* corresponding to the nozzle row, with one another. Thus, each small chamber is in communication with a discharge hole 12*e* via the second end portion of the dent 12*b* and the groove 12*c*. A depth of the groove 12*c* is larger than that of the dent 12*b*, and a cross-sectional area of the groove 12*c* is the largest at the side of the discharge hole 12*e* and gradually decreases toward an end thereof opposite to the discharge hole 12*e*. In this specific example, the depth of the groove 12*c* gradually decreases to decrease the cross-sectional area of the groove 12*c*. However, the cross-sectional area may be gradually decreased by decreasing a width of the groove. Where the nozzle row is long, it is preferable that the discharge hole 12*e* is formed at both of opposite ends of each groove 12*c* in order to further smoothly discharge ink, and in such an arrangement the groove 12*c* is the deepest at a substantially center of the nozzle row.

As shown in FIG. 2, the maintenance unit 12 includes a positioning member 22 along which the printhead 11 moves into the purging area S2 and to the purging position, and a pair of positioning pins 12*d* that are disposed on the contact surface of the purge cap 12*a* so as to precisely position the printhead 11 at the purging position. The positioning member 22 has a base portion 22*a* that is flattened U-shaped in cross section, and a pair of guiding portions 22*b* extending from opposite ends of the base portion 22*a* along the reciprocating direction of the recording device 15. The purge cap 12*a* is connected to the positioning member 22 to be integrally moved.

Figure 6:
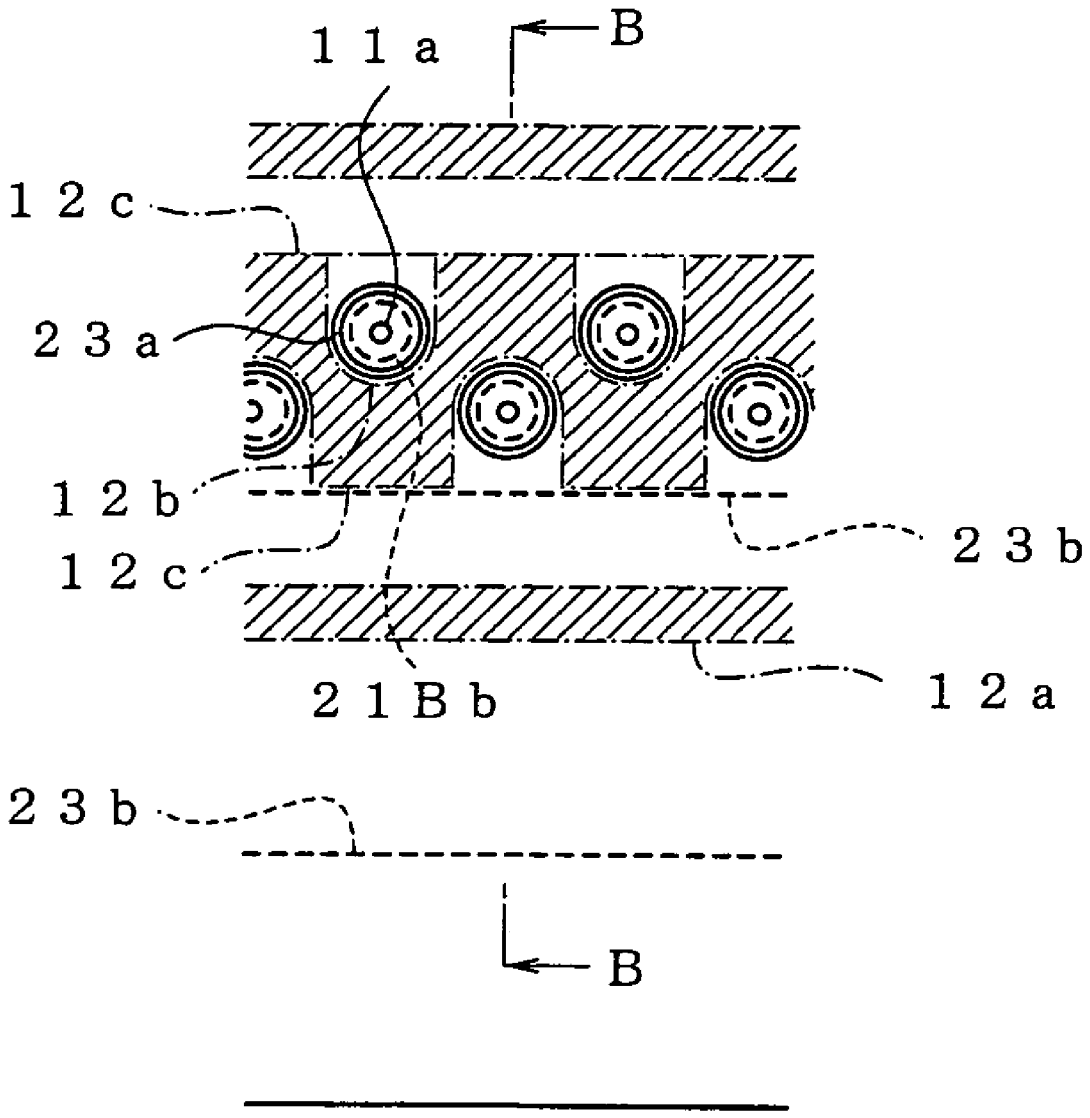
FIG. 6 is a bottom plan view of the printhead.

The front surface of the printhead 11 has a pair of positioning holes 11*b* at positions corresponding to the positioning pins 12*d*. As the printhead 11 moves into the purging area S2 by sliding on the positioning member to more or less push the positioning member 22 in the direction perpendicular to the reciprocating direction, the printhead 11 and the purge cap 12*a* connected to the positioning member 22 are properly positioned relatively to each other in the direction perpendicular to the reciprocating direction, and then the purge cap 12*a* is elevated so that the contact surface of the purge cap 12*a* covers the front surface of the printhead in a predetermined relative positional relationship therebetween while the positioning pins 12*d* are disengageably engaged with the respectively corresponding positioning holes 11*b*. While there is established the engaged state where the front surface of the printhead is covered with the purge cap 12*a* at the purging position, the first end portion of each dent 12*b* is communicated with one of the nozzles 11*a*, and thus a discrete small chamber into which the nozzle 11*a* is open is formed at the first end portion. This engaged state is shown in FIGS. 6 and 7. FIG. 6 is a plan view illustrating the state where the printhead 11 and the purge cap 12*a* are in engagement, and showing in enlargement a part including two nozzle rows. In FIG. 6, edges of the purge cap 12*a* are indicated by alternate long and short dash line, an area corresponding to the recess 23*b* formed in the cover plate 23 is indicated by broken line, and an area at which the contact surface contacts the front surface of the printhead is indicated by hatching. FIG. 7 is a cross-sectional view taken along line B-B in FIG. 6.

There are formed a plurality of the grooves 12*c* corresponding to the respective color inks, each of which extends along the nozzle row. Each groove 12*c* is communicated with only dents 12*b* that correspond to nozzles 11*a* for a same color ink, in order to prevent color mixing. As described above, the cross-sectional area of the groove 12*c* gradually increases toward the end thereof on the downstream side, from which the ink is discharged off the purge cap 12*a*. Thus, the cross-sectional area gradually increases toward the downstream side of the groove 12*c* with respect to flow of the discharged ink, thereby ensuring smoothness of the ink flow. The end of the groove 12*c* on the downstream side is communicated with the discharge hole 12*e* that is connected to the suction pump.

In the above-described arrangement, the recording device 15 first moves in sliding contact with the positioning member 22 to the purging position. In this way, the printhead and the purge cap are roughly positioned relatively to each other so as to ensure that the positioning pins 12*d* can engage with the positioning holes 11*b* when the purge cap 12*a* is elevated. When the purge cap 12*a* is actually elevated thereafter, the positioning holes 11*b* in the printhead 11 and the positioning pins 12*d* on the purge cap 12*a* are disengageably engaged with each other to position the purge cap 12*a* and the printhead 11 in a predetermined positional relationship. In this engaged state, the nozzles 11*a* are communicated with the first end portions of the dents 12*b* and the small discrete chambers into which the respective nozzles 11*a* are open are formed between the purge cap 12*a* and the printhead.

As shown in FIGS. 6 and 7, when the front surface of the printhead is covered with the purge cap 12*a* at the purging position, voids formed over the contact surface of the purge cap 12*a* and defined inside the dents 12*b* to be opposed to the nozzles 11*a* constitute small chambers into which the respective nozzles 11*a* open. The small chambers are in communication with the discharge hole 12*e* via the second end portions of the dents 12*b* and the groove 12*c*. Hence, even when bubbles are generated in an initial phase of a purging operation, the bubbles can be easily and quickly discharged along with the ink since an inner volume of each small chamber is small. Then, the small chamber which is formed under the nozzle 11*a* and from which the bubbles have been discharged is quickly filled with the ink, thereby precluding generation of bubbles thereafter.

According to the present embodiment, the purging operation is implemented for each nozzle 11*a* by utilizing the discrete small chambers formed under and around the respective nozzles 11*a*. This arrangement reduces a volume of air present around each nozzle 11*a*, and is thus advantageous in reducing occurrence of bubbles, compared to a conventional arrangement where a single large chamber is formed for all the nozzles 11*a* of a row and the purging operation is implemented for the nozzles 11*a* of the row all together.

When the purge cap 12*a* is separated from the front surface of the printhead, ink adhering to the front surface of the printhead at the vicinity of a nozzle 11*a* is usually drawn into the nozzle 11*a*. According to this embodiment, even when such drawing of the ink into the nozzle 11*a* occurs, merely fresh ink remaining around the nozzle 11*a* is drawn into the nozzle 11*a*. That is, drawing of a bubble into a nozzle 11*a* which adversely affects the ink ejection characteristic does not occur upon termination of a purging operation. Since the grooves 12*c* as main channels of the ink drain channels are provided separately for the respective color inks, color mixing does not occur, thereby making it unnecessary to implement a flashing operation which would be otherwise necessitated after a purging operation. In some situations, even it is enabled to omit a wiper or a wiping mechanism. Hence, the embodiment is advantageous in reducing the cost.

Since the nozzles 11*a* are arranged in the staggered fashion such that each dent 12*b* in the first row extends in the first direction, and each dent 12*b* in the second row adjacent to the first row extends in the second direction opposite to the first direction, a density at which the nozzles 11*a* are arranged can be increased without causing mixing of colors.

Although in the above-described embodiment the front surface of the printhead is constituted by the exposed parts of the nozzle surface as well as the external surface of the cover plate 23 in which the through-holes 23*a* are formed, the invention is not limited to this arrangement. That is, the effect of preventing drawing of a bubble into a nozzle 11*a* upon separation of the purge cap 12*a* from the front surface of the printhead, can be obtained even where the cover plate 23 is omitted. When the cover plate 23 is omitted while the nozzle film 21A is used, the positioning holes 11*b* are formed at respective positions that are outside the nozzle film 21A or alternatively formed through the nozzle film 21A. In a case where the nozzles 11*a* are formed through a metallic plate and not through the nozzle film 21A, the positioning holes 11*b* are formed in the metallic plate.

The present embodiment enables to quickly discharge, and replace with ink, bubbles that are generated during a purging operation, as described above. This is achieved by appropriately configuring the contact surface of the purge cap 12*a*. More specifically, the small discrete chambers are formed around open ends of the respective nozzles 11*a* when the contact surface contacts the front surface of the printhead. By this, a volume of a space into which each nozzle 11*a* is open is considerably reduced as compared to the conventional arrangement. When the inkjet printer is left, for a long time, in the state where the purge cap 12 is held in contact with the front surface of the printhead 11, some components of the ink evaporate into the air through the nozzles 11*a*. However, in this embodiment, the volume of the space into which each nozzle 11*a* is open is small, and thus a viscosity of the ink virtually does not increase. That is, this embodiment is advantageous in a case where the printhead 11 is not used for a long period of time with the ink stored in the printhead 11, as well as in terms of a purging operation.

There will be now described an inkjet printer according to a second embodiment of the invention, by referring to FIGS. 8-13. The parts or elements corresponding to those of the first embodiment will be denoted by the same reference numerals and description thereof is dispensed with.

Figure 8:
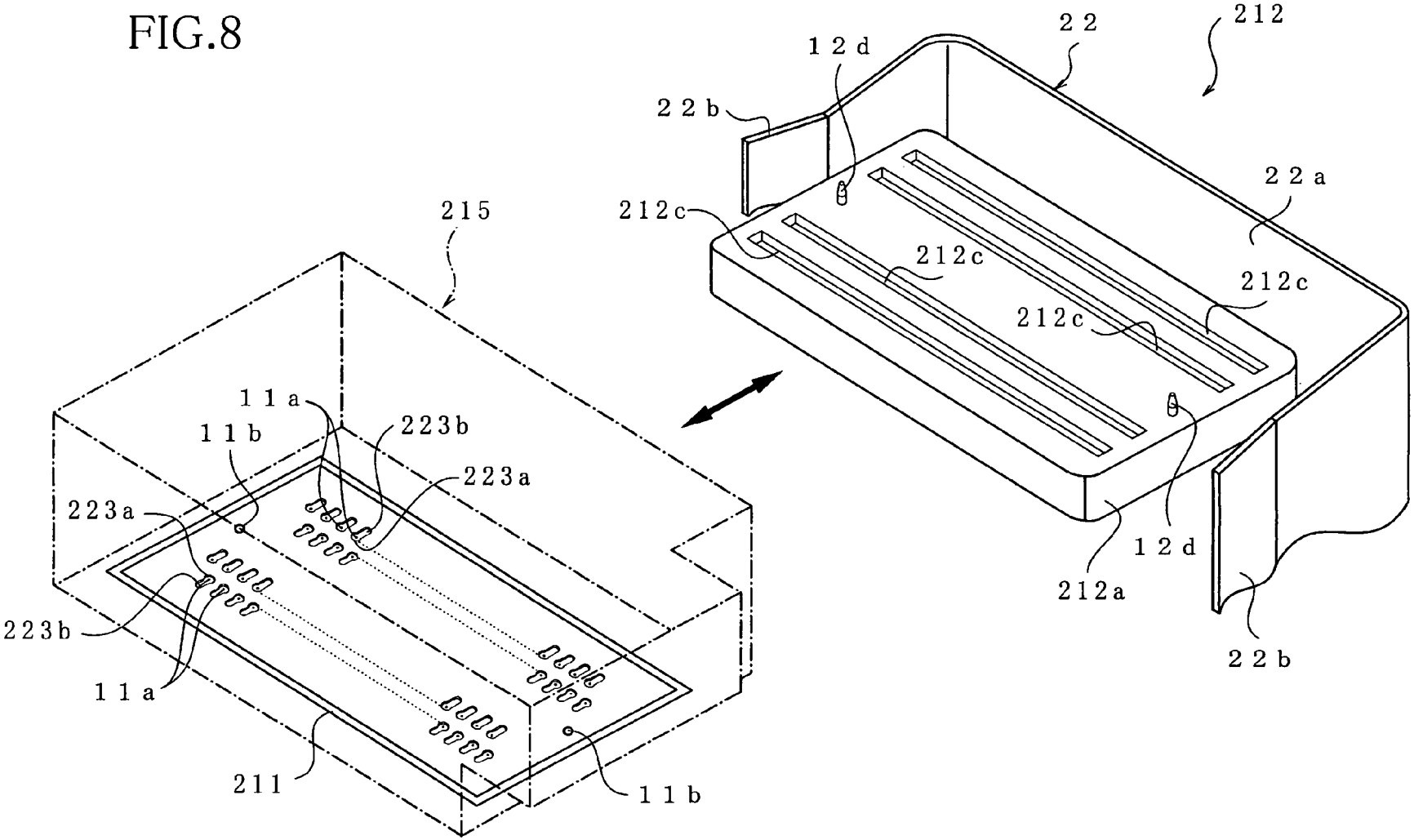
FIG. 8 is a perspective view of a printhead, a purge cap, and a positioning member of an inkjet printer according to a second embodiment of the invention.

A general structure of a principal portion of the inkjet printer according to the second embodiment is the same as that of the first embodiment, and thus description thereof is omitted. In FIG. 8, reference numerals 211 and 212 respectively denote an inkjet printhead and a purging device 212 according to the second embodiment, which differ in configuration from the corresponding elements in the first embodiment. Only the different parts will be described.

Figure 13:
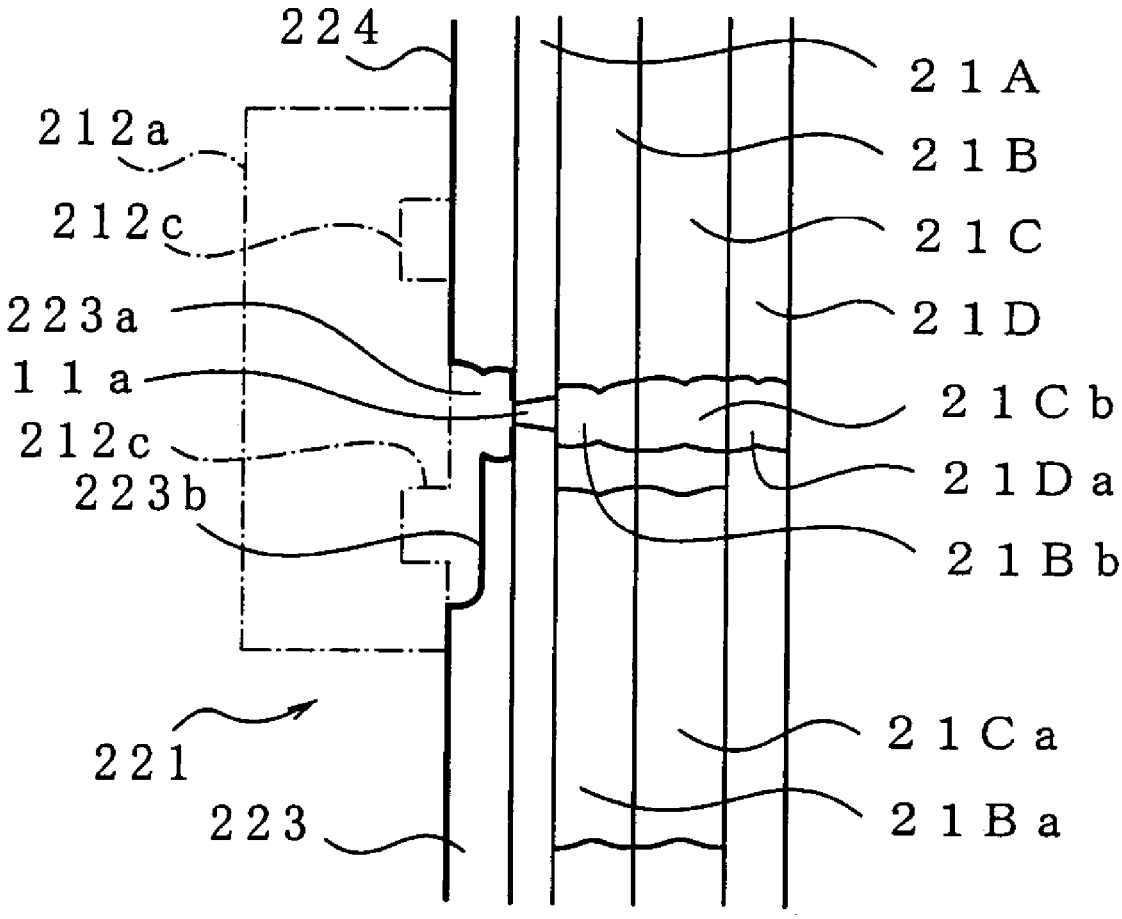
FIG. 13 is a cross-sectional view taken along line D-D in FIG. 12.

The printhead 211 is different from that 11 of the first embodiment in a structure of a cavity unit 221, which will be described by referring to FIG. 13. FIG. 13 is an enlarged fragmentary cross-sectional view of the cavity unit 221 having nozzles 11*a*, in which drawing a contour of a purge cap 212*a* line as held in contact with a front surface of the printhead 211 is indicated by chain.

The cavity unit 221 is constructed similarly to that 21 of the first embodiment, except the configuration of the cover plate. There will be described the configuration and operation of a cover plate 223 according to the second embodiment, by illustrating how a maintenance work or a purging operation is performed in the second embodiment.

The purging device 212 has the purge cap 212*a* that is brought into contact with the front surface of the printhead 211 before a purging operation to suck the ink from the nozzles 11*a* of the printhead 211 is implemented. The purge cap 212*a* is vertically displaceable in a manner similar to that in the first embodiment.

Figure 9:
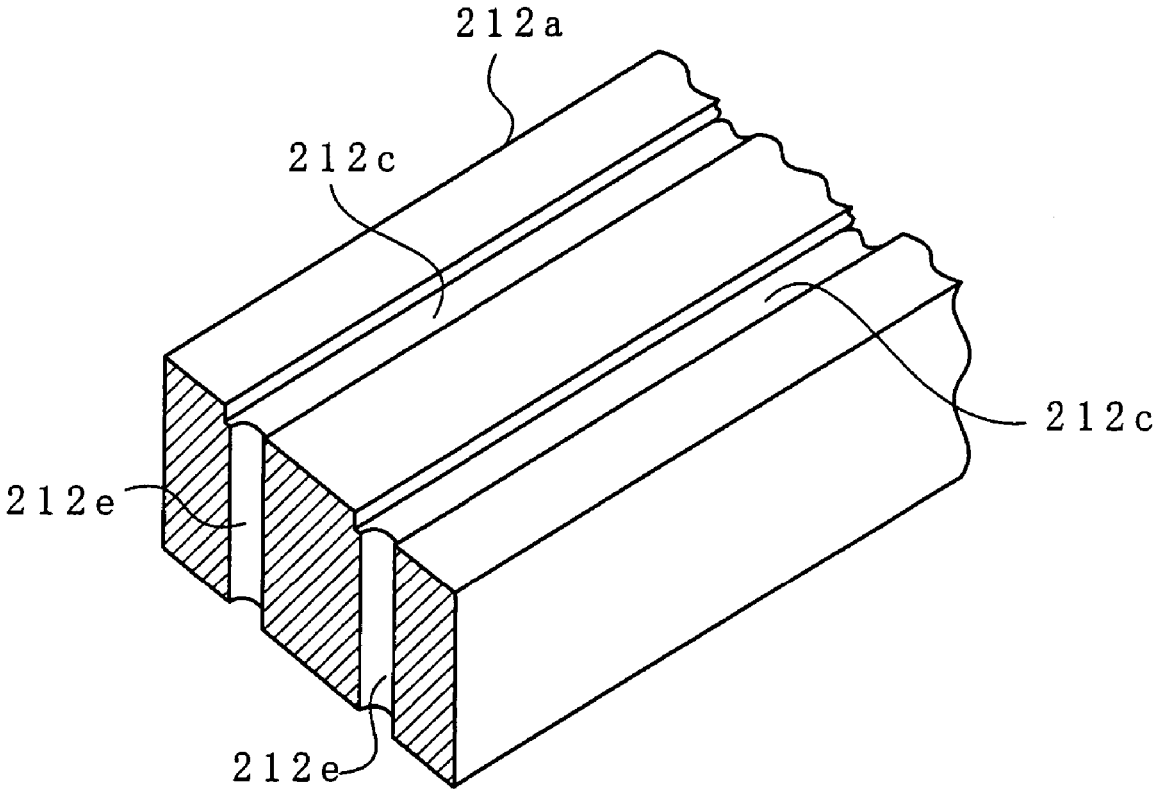
FIG. 9 shows the purge cap.
Figure 10:
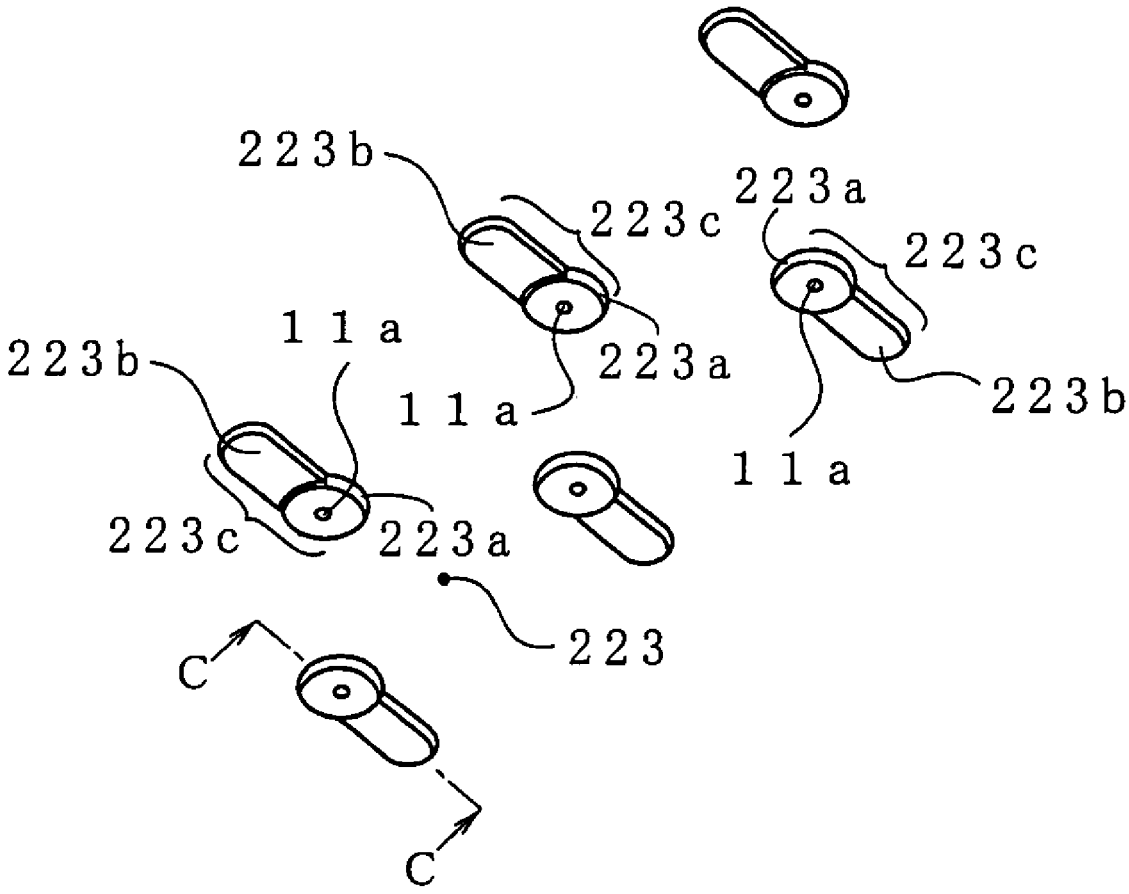
FIG. 10 illustrates a front surface of the printhead in which nozzles are arranged.
Figure 11:
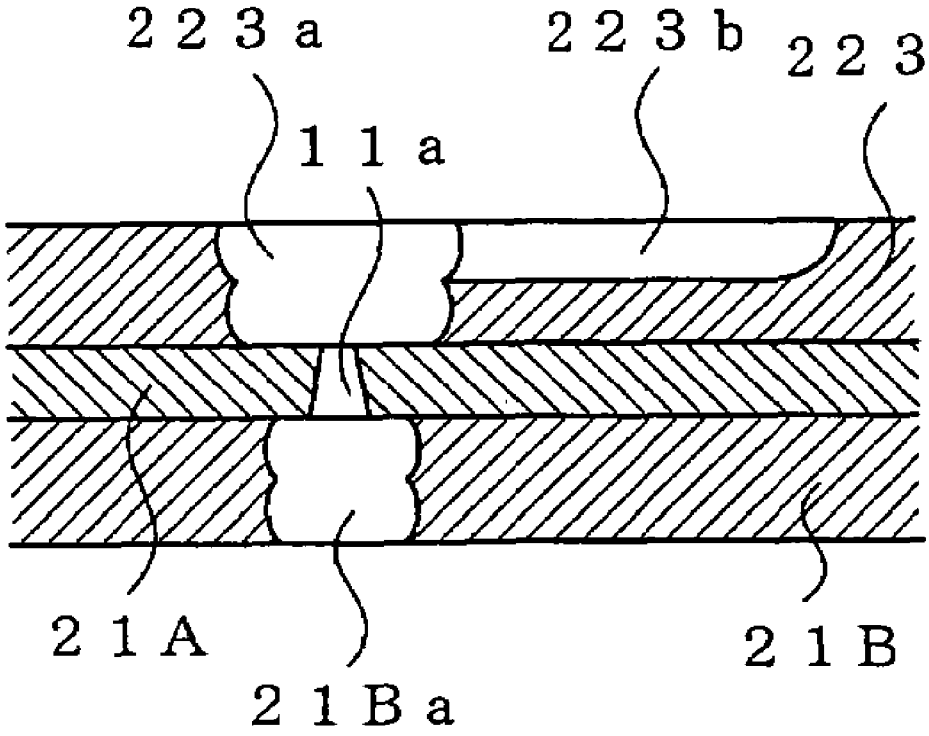
FIG. 11 is a cross-sectional view taken along line C-C in FIG. 10.

FIG. 9 is an enlarged perspective view of a part of the purge cap 212*a*, in which two nozzles are included. A structure of the purge cap 212*a* is a characterizing portion of the second embodiment of the invention. The purge cap 212*a* has a contact surface on which are formed a plurality of dents 223*c* into which the respective nozzles 11*a* open, and a plurality of grooves 212*c*. Each dent 223*c* includes a branch groove or recessed portion as a connecting portion 223*b*, and a through-hole 223*a*. That is, at the connecting portion 223*b*, a thickness of the cover plate 223 is reduced. When the front surface of the printhead 211 is covered by the purge cap 212*a* at a purging area S2, each groove 212*c* extends alongside one of the nozzle rows so as to communicate connecting portions 223*b* of the respective dents 223*c* corresponding to that nozzle row. Each of the grooves 212*c* is disposed to extend under a substantially longitudinal center of the connecting portions 223*b* of the dents 223*c*. In FIG. 9, there are shown two grooves 212*c* formed correspondingly to two adjacent nozzle rows. When the purge cap 212*a* covers the front surface of the printhead 211, a part of each dent 223*c* of the two nozzle rows is disposed between the two grooves 212*c*. One of opposite ends of each of the grooves 212*c* is in communication with a discharge hole 212*e* through which sucked ink is discharged off the purge cap 212*a*.

Figure 12:
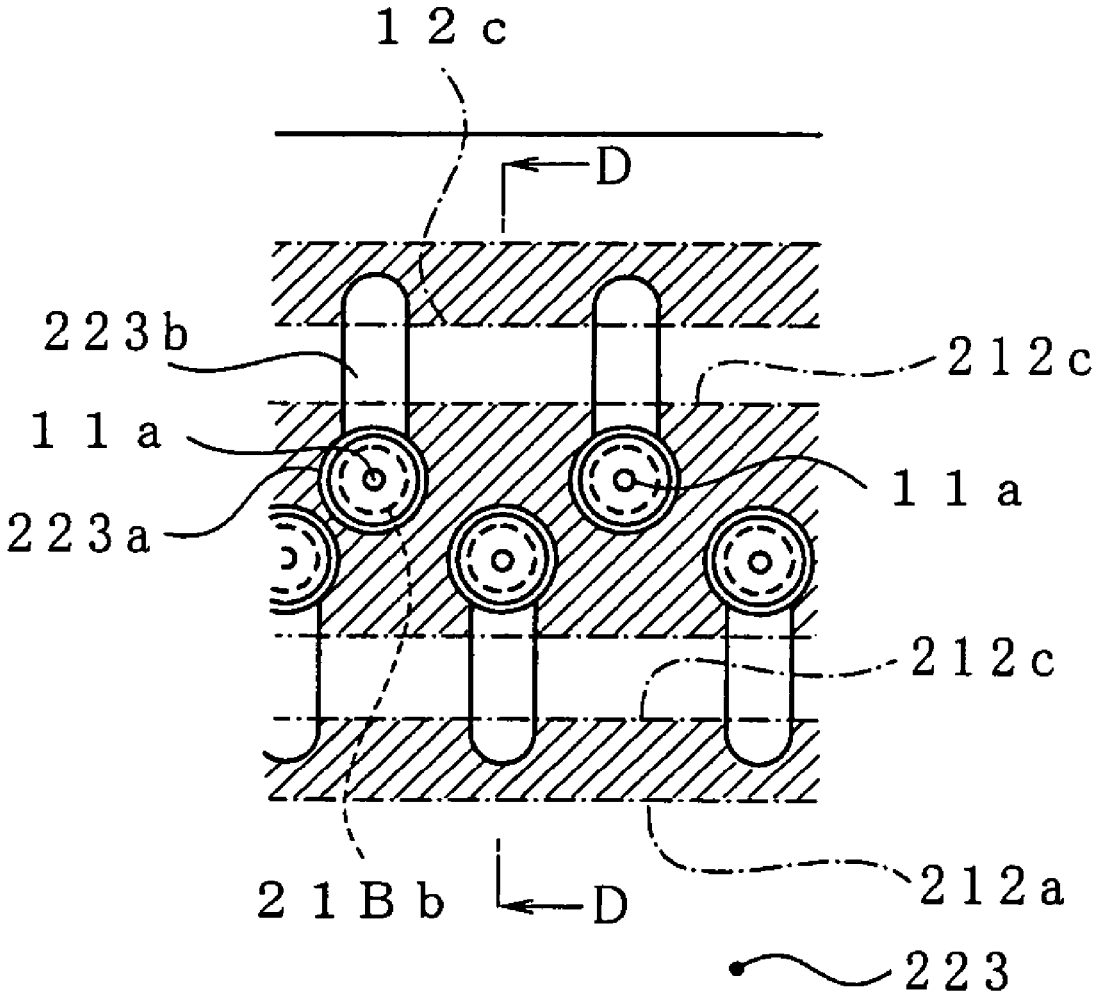
FIG. 12 is a bottom plan view of the printhead.

Similarly to the purging device 12 of the first embodiment, the purging device 212 has positioning member 22 and a pair of positioning pins 12*d*, and the front surface of the printhead 211 has two positioning holes 11*b* corresponding to the positioning pins 12*d*. When the printhead 211 and the purge cap 212*a* are brought into contact, these members 211, 212*a* are properly positioned relatively to each other by engagement of the positioning pins 12*d* and the positioning holes 11*b*. The engaged state is shown in FIGS. 12 and 13, in which FIG. 12 is a plan view of a principal portion of the printhead 211 and the purge cap 212*a* in engagement, which portion includes two nozzle rows. In FIG. 12, the purge cap 212*a* is indicated by chain line, and an area at which the contact surface contacts the front surface of the printhead 211 is indicated by hatching. FIG. 13 is a cross-sectional view taken along line D-D in FIG. 12. As shown in FIG. 12, when a closed or contact state where the front surface of the printhead 211 is covered by the purge cap 212*a* is established, a part of the contact surface between the two grooves 212*c* is brought into contact with the cover plate 223, thereby closing open ends of the nozzles 11*a* of the two nozzle rows, and accordingly the corresponding through-holes 223*a* and the dents 223*c* communicated therewith. Between the purge cap 212*a* and the printhead 211, there are formed discrete small voids or chambers which are defined by first end portions of the dents 223*c*, and into which the nozzles 11*a* open. As shown in FIG. 13, a small chamber is partially constituted by each through-hole 223*a*. Each small chamber is communicated with a discharge hole 212*e* via one of the grooves 212*c* formed in the purge cap 212*a*. Even when the purge cap 212*a* and the front surface of the printhead 211 contact each other with a slight relative positional error in a reciprocating direction of the printhead 211, the positional relationship between the dents 223*c* and the groove 212*c* reliably ensures that the groove 212*c* is opposed to the dents 223*c* or the nozzles 11*a* (or the through-holes 223*a*). Thus, the present embodiment gives a high degree of freedom with respect to a positional error in the reciprocating direction of the printhead 211. It is noted that a positional error between the dents 223*c* and the groove 212*c* in a direction perpendicular to the reciprocating direction of the printhead 211 can be accommodated by forming the groove 212*c* to have a length larger than a range across which the dents 223*c* are arranged in a row.

A plurality of grooves 212*c* are formed parallel to one another correspondingly to the nozzle rows for the respective color inks. Each groove 212*c* is communicated with the dents 223*c* corresponding to the nozzles 11*a* for a same color ink, in order to prevent color mixing. That is, four grooves 212*c* are provided, and only an ink of a particular color flows in each groove 212*c*.

Similarly to the groove 12*c* in the first embodiment, each groove 212*c* has a cross-sectional area gradually increasing toward a downstream side with respect to the ink flow, and is communicated with a discharge hole 212*e* at an end thereof on the downstream side.

In the inkjet printer constructed as described above, the printhead 211 is guided by the positioning member 22 at the purging position, and then positioning holes 11*b* formed in the printhead 211 disengageably engage the positioning pins 12*d* on the purge cap 212*a*, and in this engaged state the front surface of the printhead 211 is covered by and held in contact with the purge cap 212*a*. In this contact state, the individual small chambers are formed between the purge cap 212*a* and the printhead 211, at the first end portions of the dents 223*c*.

That is, as shown in FIGS. 12 and 13, when the front surface of the printhead 211 is covered with the purge cap 212*a* at the purging position, a small chamber into which a nozzle 11*a* opens is defined at the first end portion of each dent 223*c*, by a wall surface of the through-hole 223*a* and the contact surface of the purge cap 212*a*. The small chamber is communicated with a discharge hole 212*e* via the connecting portion 223*b* and the groove 212*c*. With an inner volume of the small chamber being small, even when bubbles are generated in the small chamber in an initial phase of the purging operation, the bubbles are easily and quickly discharged along with the ink. The small chamber into which the nozzle 11*a* opens and from which all the bubbles have been discharged, is filled with ink, and a bubble does not occur thereafter. Thus, in the second embodiment also, a discrete small chamber is formed for each nozzle 11*a* when the purging operation is implemented, so as to reduce a volume of air present around the nozzle 11*a*, because this arrangement is considerably advantageous in reducing generation of bubbles.

The same effects as the first embodiment can be obtained according to the second embodiment. Namely, when the purge cap 212*a* is separated from the printhead 211, the ink adhering to the front surface of the printhead 211 at the vicinity of a nozzle 11*a* may be drawn into the nozzle 11*a*. However, even when this drawing of ink into the nozzle 11*a* occurs in the printer according to this embodiment, only a fresh ink remaining around an open end of the nozzle 11*a* is drawn into the nozzle 11*a*, and drawing of a bubble which may adversely affect the ink ejection characteristic of the printhead 211 does not occur upon termination of the purging operation. Since the grooves 212*c* along which the inks sucked from the nozzles are flown to be discharged off the purge cap 212*a* are provided for the respective color inks, the problem of color mixing is dissolved, thereby omitting the flashing operation which would be otherwise necessary to be implemented after the purging operation. Further, in some situations, a wiper and a wiper mechanism can be omitted, contributing to reduction of the cost.

In particular, the nozzles 11*a* are arranged in a staggered fashion, and the connecting portions of two dents 223*c* adjacent in an extending direction of each nozzle row extend from the respective through-holes 223*a* in respective directions opposite to each other, thereby enabling to increase the arrangement density of the nozzles 11*a* without causing color mixing.

In the above-described embodiment, the connecting portion 223*b* is formed in the form of a recessed portion in communication with the through-hole 223*a* at one end thereof. However, the connecting portion which connects each through-hole 223*a* with the groove 212*c* may be formed through the thickness of the cover plate 223, and not a recessed portion formed on the cover plate 223.

Figure 14:
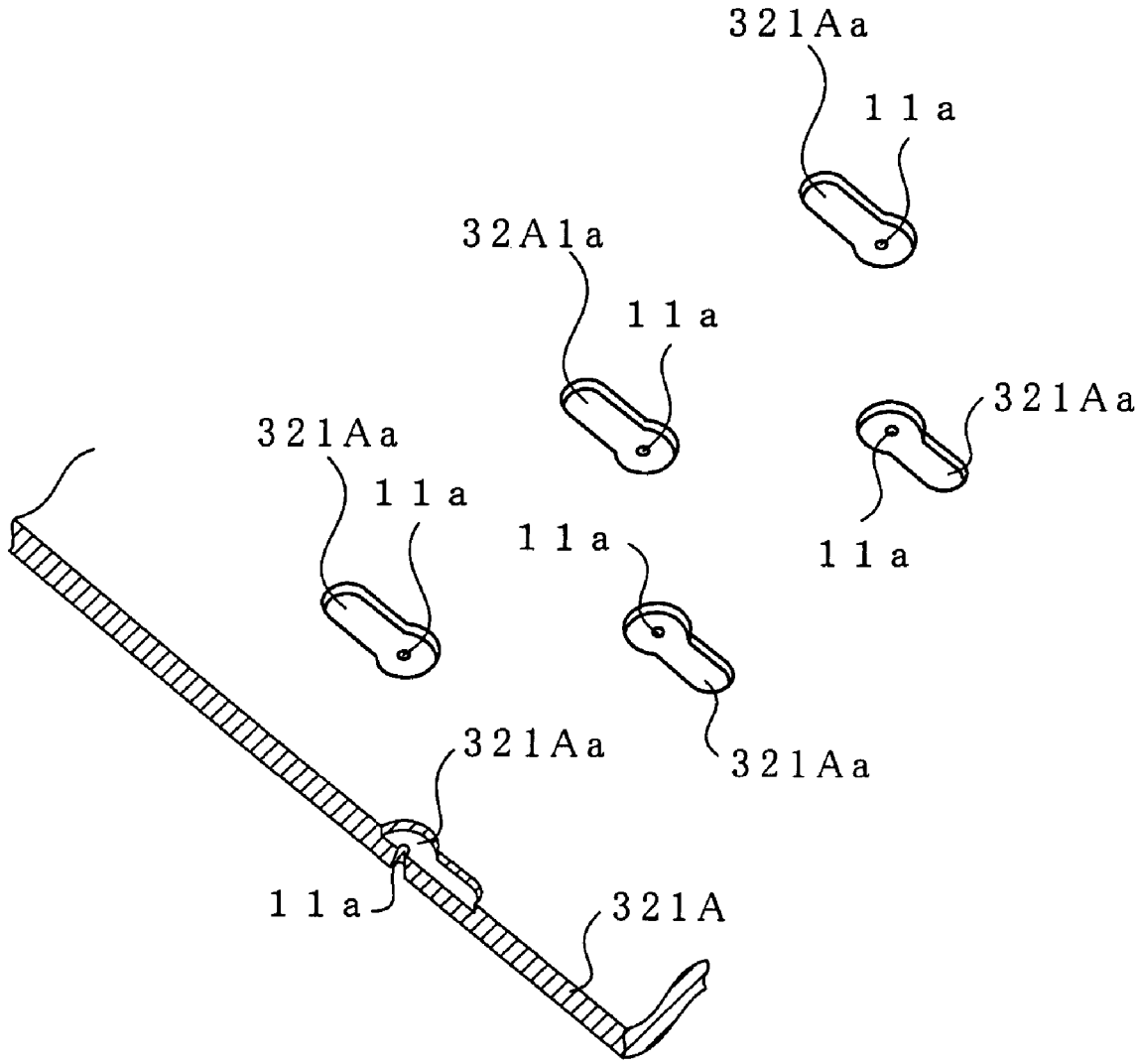
FIG. 14 illustrates a front surface of a printhead of an inkjet printer according to a third embodiment of the invention.

There will be now described an inkjet printer according to a third embodiment of the invention, by referring to FIG. 14. The inkjet printer of the third embodiment is different from that of the second embodiment in the structure of the printhead. Only the different part will be described, and the parts or elements corresponding to those of the second embodiment will be denoted by the same reference numerals and description thereof is not provided.

As seen in FIG. 14 showing a front surface of the printhead, the printhead of the third embodiment does not include a cover plate covering a nozzle film 321A. A plurality of dents 321Aa whose depth is about 5-10 μm are formed on the nozzle film 321A by irradiating the nozzle film 321A with an excimer laser beam.

By this arrangement, the same effects as the first and second embodiments of the invention can be obtained.

Figure 15:
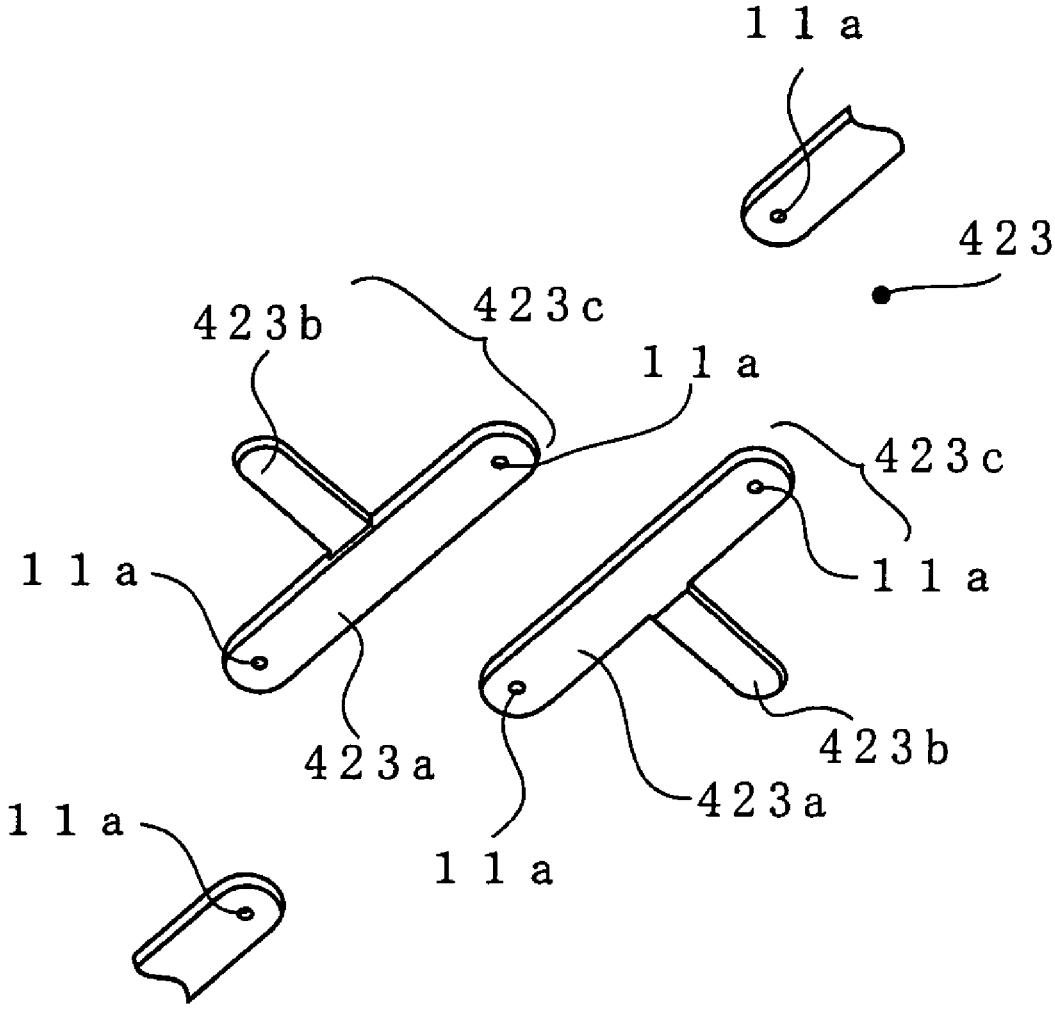
FIG. 15 illustrates a front surface of a printhead of an inkjet printer according to a fourth embodiment of the invention.

There will be now described an inkjet printer according to a fourth embodiment of the invention, by referring to FIG. 15. The inkjet printer of the fourth embodiment is different from that of the second embodiment in the structure of the printhead. Only the different part will be described, and the parts or elements corresponding to those of the second embodiment will be denoted by the same reference numerals and description thereof is not provided.

In the above-described second embodiment, a dent 223*c* including a through-hole 223*a* and a connecting portion 223*b* is formed through the cover plate 223, for each nozzle 11*a*. However, according to the fourth embodiment shown in FIG. 15, a dent 423*c* includes an elongate through-hole 423*a* and a connecting portion 423*b*, and the elongate through-hole 423*a* is formed commonly for two adjacent nozzles 11*a*, namely, two nozzles are open in a single elongate through-hole 423*a*. This arrangement of the fourth embodiment may be employed where the nozzles are arranged in each row at a suitable pitch. To quickly discharge bubbles generated in a small chamber defined by the through-hole 423*a*, the connecting portion 423*b* is formed to extend from a longitudinal central portion of the through-hole 423*a* and in a direction to intersect the nozzle row. In this fourth embodiment, similarly to the second embodiment, it is preferable that each connecting portion 423*b* is a groove formed on a cover plate 423. For instance, the connecting portion 423*b* is formed by etching the cover plate 423 halfway in a direction of its thickness direction.

Although not shown, the fourth embodiment may be modified as follows. That is, two adjacent through-holes formed similarly to those in the second embodiment are connected by a groove formed by etching the cover plate 423 halfway in the thickness, so that an inner volume of the small chamber formed when the purging operation is implemented is reduced, contributing to quickly discharging the bubbles. In this arrangement, too, the connecting portion 423*b* is formed to extend from a longitudinal central portion of the groove formed by etching the cover plate halfway in the thickness direction.

The effect described above and the other effects obtained by the first embodiment are obtained by the fourth embodiment and its modification also.

Figure 16:
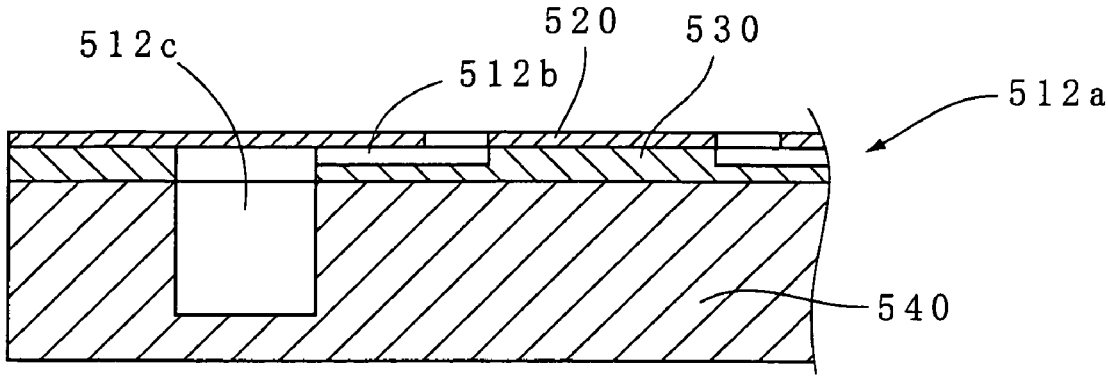
FIG. 16 is a view of a purge cap in an inkjet printer according to a fifth embodiment of the invention.

There will be described an inkjet printer according to a fifth embodiment of the invention, by referring to FIG. 16. The fifth embodiment is similar to the fist embodiment, and thus only the different part will be described. The parts or elements corresponding to those of the first embodiment will be denoted by the same reference numerals and description thereof is omitted.

In the fifth embodiment, a purge cap 512*a* is formed of a combination of an elastic material 540 and two metal sheets

520, 530. The metal sheets 520, 530 are disposed on a surface of the elastic material 540 on a side to be opposed to the printhead. By forming the contact surface with the metal sheet 520, there is ensured, without increasing the thickness of an upper wall covering branches 512*b*, which correspond to the dents 12 in the first embodiment, and grooves 512*c*, a sufficient rigidity to assure that the branches 512*b* are not deformed to be closed when the purge cap 512*a* is brought into contact with the printhead, and that when the purge cap 512*a* is separated away from the printhead from a state that the purge cap 512*a* and the printhead are held in contact with each other with the grooves 512*c* and/or branches 512*b* deformed, air bubbles or discharged ink containing air bubbles present in the grooves 512*c* and/or branches 512*b* is not flowed or sucked back into nozzles because of elimination of the deformation of the branches 512*b* and/or the grooves 512*c*.

As a modification of the fifth embodiment, an entirety of the purge cap 512*a* may be formed of elastic material.

The fifth embodiment and its modification also give the same effects as the first embodiment. In addition, according to the fifth embodiment and its modification, the front surface of the printhead is less stained with ink because of the purging operation, as compared to each of the above-described embodiments, since the ink drain channels are exposed at an area smaller than that of each of the above-described embodiments when the purge cap is separated from the printhead.

What is claimed is:

1. An inkjet printer comprising:

a printhead having a front surface in which is formed a nozzle row consisting of a plurality of nozzles from each of which a droplet of ink is ejected;

a maintenance unit including a purge cap which receives ink from the nozzles during a purging operation, the purge cap having a contact surface to be brought into contact with the front surface of the printhead, and a main channel extending alongside the nozzle row; and a plurality of dents formed on at least one of the contact surface of the purge cap and the front surface of the printhead so as to form, at least when the contact surface is in contact with the front surface, a plurality of branches each of which has at least one end portion, each of the branches being in communication with at least one of the nozzles only at the at least one end portion while being in communication with the main channel at least a part of an other portion thereof than the at least one end portion, each of the at least one end portion connecting with only one of the plurality of branches.

2. The inkjet printer according to claim 1, wherein a depth of each of the branches is smaller than a depth of the main channel.

3. The inkjet printer according to claim 1, wherein a plurality of the nozzle rows are formed in the front surface of the printhead, and a plurality of the main channels respectively corresponding to the nozzle rows are formed on the contact surface of the purge cap, and wherein, at least when the contact surface is in contact with the front surface, a plurality of the branches corresponding to each one of the nozzle rows are in communication with a corresponding one of the main channels.

4. The inkjet printer according to claim 1, wherein a main groove is formed in the contact surface of the purge cap to extend alongside the nozzle row when the contact surface is in contact with the front surface of the printhead, and the main channel is formed by the main groove as covered with the front surface.

5. The inkjet printer according to claim 4, wherein the dents are formed on at least one of the front surface of the printhead and the contact surface of the purge cap such that an entirety of each of the dents is open in the at least one surface.

6. The inkjet printer according to claim 5, wherein the dents are formed in the contact surface such that when the contact surface is in contact with the front surface, a first one of opposite end portions of each of the dents is opposed to at least one of the nozzles, a second one of the opposite end portions of the dent is communicated with the main groove, and the branches are formed by the dents as covered by the front surface.

7. The inkjet printer according to claim 6, wherein a plurality of the nozzle rows are formed in the front surface of the printhead, a plurality of the main grooves respectively corresponding to the nozzle rows are formed on the contact surface of the purge cap, and the dents corresponding to each one of the nozzle rows are communicated at the second end portions thereof with a corresponding one of the main grooves.

8. The inkjet printer according to claim 5, wherein the dents are formed in the front surface such that a first end portion of each of the dents surrounds an open end of at least one nozzle, a part of the each dent overlaps the main groove when seen from a direction perpendicular to the front surface, and the branches are formed by the dents as covered by the contact surface.

9. The inkjet printer according to claim 8, wherein a plurality of the nozzle rows are formed in the front surface of the printhead, a plurality of the main grooves respectively corresponding to the nozzle rows are formed on the contact surface of the purge cap, and the dents corresponding to each one of the nozzle rows are formed such that a part of each of the dents overlaps a corresponding one of the main grooves when seen in a direction perpendicular to the contact surface.

10. The inkjet printer according to claim 5, wherein at least two nozzle rows are formed parallel to each other in the front surface of the printhead such that a first one of the nozzle rows and a second one of the nozzle rows are misaligned in an extending direction of each nozzle row, by half a pitch at which the nozzles of each nozzle row are arranged, and each of the dents corresponding to the first nozzle row and each of the dents corresponding to the second nozzle row extend in respective directions away from each other.

11. The inkjet printer according to claim 4, wherein each of the dents includes a circular portion at a center of which one of the nozzles is located, and a connecting portion which connects the circular portion with the main groove.

12. The inkjet printer according to claim 1, wherein the printhead has a cover plate, which covers a nozzle surface in which the nozzles are open, and has a plurality of through-holes at positions corresponding to the nozzles to expose the nozzles therethrough, a surface of the cover plate opposite to the nozzle surface constitutes the front surface, and each of the through-holes constitutes a part of each of the branches.

13. The inkjet printer according to claim 12, wherein a main groove is formed in the contact surface of the purge cap to extend alongside the nozzle row when the contact surface is in contact with the front surface of the printhead, wherein when the contact surface is in contact with the front surface, the main channel is formed by the main groove as covered by the front surface, and wherein the dents are formed on the contact surface and each of the dents includes a main portion opposed to a corresponding one of the through-holes, and a connecting groove which connects the main portion with the main groove.

14. The inkjet printer according to claim 12, wherein a main groove is formed in the contact surface of the purge cap to extend alongside the nozzle row when the contact surface is in contact with the front surface of the printhead, wherein when the contact surface is in contact with the front surface, the main channel is formed by the main groove as covered by the front surface, and wherein the dents are formed on the front surface and each of the dents is constituted by one of the through-holes and a connecting groove which is also formed in the cover plate and one end of which is communicated with the through-hole, a part of the connecting groove overlapping the main groove when seen from a direction perpendicular to the front surface.

15. The inkjet printer according to claim 14, wherein a longitudinal central portion of the connecting groove is opposed to a part of the main groove.

16. The inkjet printer according to claim 1, wherein the branches are formed for the respective nozzles.

17. The inkjet printer according to claim 1, wherein a cross-sectional area of the main channel increases toward a downstream side with respect to flow of the ink.

18. The inkjet printer according to claim 1, wherein the printhead moves between a recording area in which the printhead performs recording, and a purging area at a side of the recording area, wherein the maintenance unit includes:

a positioning member that is brought into contact with the printhead as moving into the purging area, so as to position the printhead and the maintenance unit relatively to each other; and a positioning pin disposed on the purge cap, and wherein the printhead includes a positioning hole that engages with the positioning pin so that the printhead and the purge cap are positioned relatively to each other more precisely than by the positioning member.

19. The inkjet printer according to claim 18, wherein the purge cap moves with the positioning member when the purge cap moves toward and away from the printhead at the purging area, such that the positioning member moves along the printhead.

20. The inkjet printer according to claim 1, wherein the printhead moves between a recording area in which the printhead performs recording, and a purging area at a side of the recording area, wherein the maintenance unit includes a positioning pin disposed on the purge cap, and wherein the printhead includes a positioning hole that engages with the positioning pin so that the printhead and the purge cap are positioned relatively to each other.

21. The inkjet printer according to claim 1, wherein a part of each of the plurality of dents are formed in a direction corresponding to the nozzle row independently of each other.

22. The inkjet printer according to claim 21, wherein each part of each of the plurality of dents is in communication with one of the plurality of nozzles.

* * * * *